US005399043A

United States Patent [19]

Plumeyer

[11] Patent Number: 5,399,043

[45] Date of Patent: Mar. 21, 1995

[54] JOINT CONNECTION-SYSTEM FOR PLANAR OR THREE-DIMENSIONAL TRUSSES

[75] Inventor: Klaus Plumeyer, Hoechberg, Germany

[73] Assignee: MERO-Raumstruktur GmbH & Co., Wurzburg, Germany

[21] Appl. No.: 82,318

[22] Filed: Jun. 28, 1993

[30] Foreign Application Priority Data

Jul. 25, 1992 [DE] Germany ..... 42 24 697.0

[51] Int. Cl.[6] ..... E04H 12/00

[52] U.S. Cl. ..... 403/171; 403/176; 52/655.2; 446/126

[58] Field of Search ..... 403/170, 171, 176, 217; 52/655.2; 446/123, 126

[56] References Cited

U.S. PATENT DOCUMENTS

| | | | |
|---|---|---|---|
| 3,789,562 | 2/1974 | De Chicchis et al. | 403/176 |
| 3,890,022 | 6/1975 | Moon | 403/171 |
| 4,313,687 | 2/1982 | Martinez Apeztgui et al. | 403/171 |
| 4,915,533 | 4/1990 | de la Haye | 403/171 |

FOREIGN PATENT DOCUMENTS

| | | |
|---|---|---|
| 2628461 | 3/1988 | France . |
| 3219520A1 | 5/1982 | Germany . |
| 4009371C2 | 3/1990 | Germany . |
| WO90/11416 | 3/1990 | Japan . |

*Primary Examiner*—Edward K. Look
*Assistant Examiner*—James A. Larson
*Attorney, Agent, or Firm*—Lowe, Price, LeBlanc & Becker

[57] ABSTRACT

In order to lower the number of individual components in joint connection-systems of planar or three-dimensional trusses of members and joints and further to reduce the frictional surfaces when implementing a member connection and to make possible a controlled prestressing force, the pipe members 10 comprise member-endpieces 14 with a borehole 16 passing a tap bolt 12 followed inward by a threaded borehole 17 into which is rotated a prestressing muff 18 with an outer thread. When the tap bolt 12 is screwed into a threaded borehole 13 of a joint-adapter 11, the inside end face of the member-endpieces 14 forms a stop for the head 26 of the tap bolt 12. A non-circular segment 23 with flats 25 to seat a corresponding rotating tool is provided to rotate the tap bolt 12 into a threaded borehole 13 of a joint-adapter 11. The prestressing muff 18 passing the tap bolt 12 through its axial borehole 21 is rotated out of the particular member-endpiece 14 and is moved to rest against the joint-adapter 11 to prestress the tap bolts 12. Further rotation in the same direction implements the prestressing of the bolt shank.

5 Claims, 2 Drawing Sheets

JOINT CONNECTION-SYSTEM FOR PLANAR OR THREE-DIMENSIONAL TRUSSES

FIELD OF THE INVENTION

The invention concerns a joint connection-system for planar or three-dimensional trusses of bars, i.e. members and joint-adapters with threaded boreholes in these adapters to receive tap bolts extending each through a borehole in bar-endpieces irrotationally affixed to a member and each forming a stop for the bolt head, these tap bolts being rotatable by suitable drive means into the threaded boreholes of the joint-adapters and lending themselves to being axially prestressed by a clamping muff enclosing the tap bolts and operative between member-endpieces and the joint-adapters.

BACKGROUND ART

Such a joint connection-system with a device for axially prestressing the threaded, i.e. tap bolts is disclosed in the German Offenlegungsschrift 3,219,520. By axially prestressing such threaded or tap bolts, the danger of breaking them, which arises upon long-lasting dynamic loads, will be counteracted. In the kindred solution disclosed in the above Offenlegungsschrift, a so-called drive muff is used to rotate the tap bolt into a threaded borehole of a joint-adapter. This drive muff is irrotational because of a drive pin entering an axial groove in the shank of the tap bolt, but on the other hand it is axially displaceable along the said shank. The drive muff comprises a hexagonal segment to seat a wrench or the like and further a threaded segment onto which is screwed a prestressing muff with a corresponding threaded borehole. The prestressing muff projects axially beyond the threaded segment of the drive muff and also comprises a hexagonal segment at its outer periphery to seat a corresponding wrench or the like. Once the tap bolt has been screwed into the joint-adapter, it shall then be prestressed and the prestressing muff will be rotated relative to the drive muff. As a result the distance between a member-endpiece and joint-adapter is enlarged and the shank of the tap bolt is correspondingly prestressed. However this procedure is fairly cumbersome because of the need to use a drive muff and a prestressing muff for each member connection. Moreover it is fairly difficult to tightly control the magnitude of the prestressing force.

SUMMARY OF THE INVENTION

The object of the invention is to so further develop a joint connection-system of the initially cited kind that fewer parts will be needed and that the prestressing force can be applied in defined manner. At the same time the number of frictional surfaces shall be reduced when rotating the tap bolt into the joint-adapter.

The invention solves the above problem in that a) the member-endpieces comprise an outward, threaded borehole next to the smooth-cylindrical borehole passing the tap bolt, the threaded borehole being coaxial with the smooth one and receiving the prestressing muff comprising a matching external thread, b) the prestressing muff comprises an axial borehole to pass the tap bolt, and c) the rotational drive means consists of a non-circular segment, for instance comprising flats or radial boreholes at the shank of the tap bolts.

The separate drive muff of the state of the art is eliminated and hence the desired saving in parts is achieved. The said drive muff is replaced by a non-circular segment of the tap-bolt shank, for instance a square or hexagonal segment formed by appropriate flats and allowing application of a suitable wrench for rotation in order to turn the tap bolt into a threaded borehole of a joint-adapter. Thereupon the prestressing muff can be rotated out of the member-endpiece and, as soon as it is resting against the joint-adapter, the tap-bolt shank can be prestressed by further rotation of the prestressing muff, it being essential in this respect that the prestressing force can be controlled. Preferably the member-endpieces consist of relatively elongated and essentially frusto-conical units of such length that the required smooth-cylindrical borehole passing the tap bolt, and thereafter the threaded borehole receiving a prestressing muff, shall be present in adequate lengths. Moreover it is important to minimize frictional surfaces when rotating a tap bolt into a joint-adapter and when thereafter prestressing the tap bolt.

The sub-claims state embodiment modes of the invention. Illustratively the length of the threaded boreholes in the member-endpieces is equal to or only slightly less than the length of the prestressing muff. Thereby the prestressing muffs can be "sunk" into the member-endpieces and be housed to be protected against mechanical damage when being shipped or stored, for instance at a construction site.

The design may be such that the prestressing muffs comprising drive flats at one end shall project only by those flats from the member-endpieces when they are fully screwed-in. The threaded part of the tap bolt projecting from the prestressing muff or member-endpiece can be protected against mechanical damage during shipping by an illustratively plastic cap. If on the other hand the prestressing muffs are the same length as the threaded boreholes in the member-endpieces, then the prestressing muffs also may be rotated into the member-endpieces so as to be fully sunk. In that case the prestressing muffs may be fitted with drive boreholes parallel to the axis at their outer end faces to receive drive pins of suitable rotating tools.

In a further embodiment mode of the invention a securing element to prevent the tap bolt from moving out of the member-endpieces is mounted in the hollow members next to the member-endpieces and is affixed to the inside wall of the members and/or to the member-endpieces. Illustratively the securing element may be a plain disk or a strip welded transversely to the axis of each member end at a defined distance from the butt edges of the member. Alternatively the securing element also may be a clip overlapping the bolt head with some axial play and affixed to the inside of the end face of the member-endpiece.

In yet a further embodiment mode of the invention, the securing element to prevent the tap bolt from moving out of the member-endpieces is a stop, for instance a securing pin mounted inward to the shank of the tap bolt and cooperating with the outer end of the pressure muff, this end of the pressure muffs being provided with a annular recess to receive the stop which thereby is housed in sunk manner. If during the prestressing of a tap bolt the pressure muff rests by its outer end face against the pertinent joint-adapter, then the stop at the shank of the tap bolt shall be located inside the annular recess at the outer end face of the pressure muff so as not to interfere with prestressing.

BRIEF DESCRIPTION OF THE DRAWINGS

The invention is elucidated below in relation to the drawing showing an illustrative embodiment.

DESCRIPTION OF THE PREFERRED EMBODIMENTS

Figure 1:
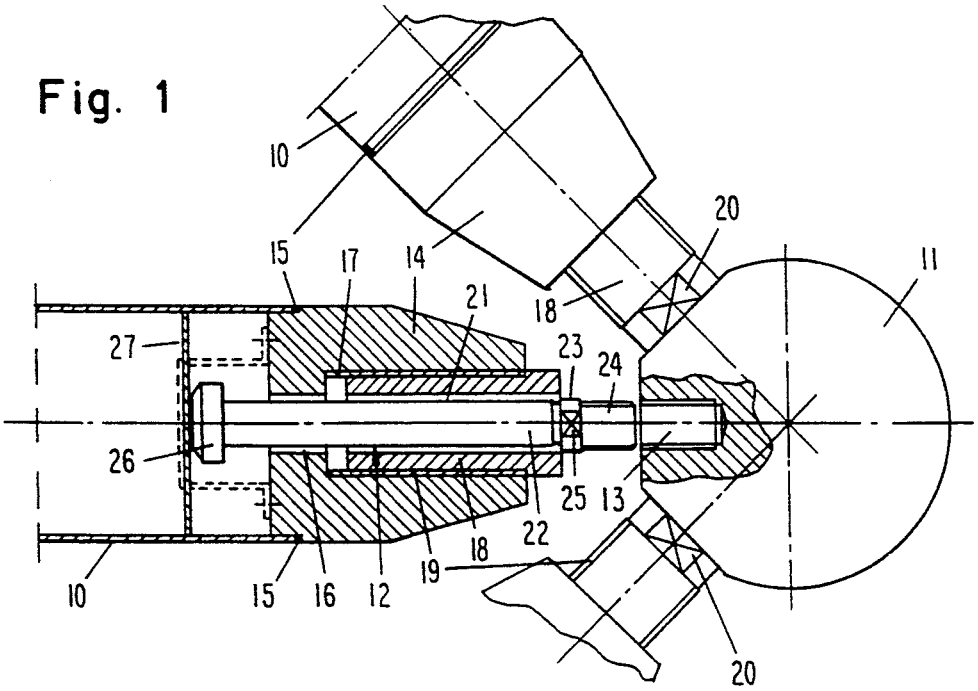
FIG. 1 is joint connection-system in a three-dimensional truss of pipe-members and joint-adapters with two complete bar, i.e. member connectors and a third member connector, partly shown in section, which remains to be completed.
Figure 2:
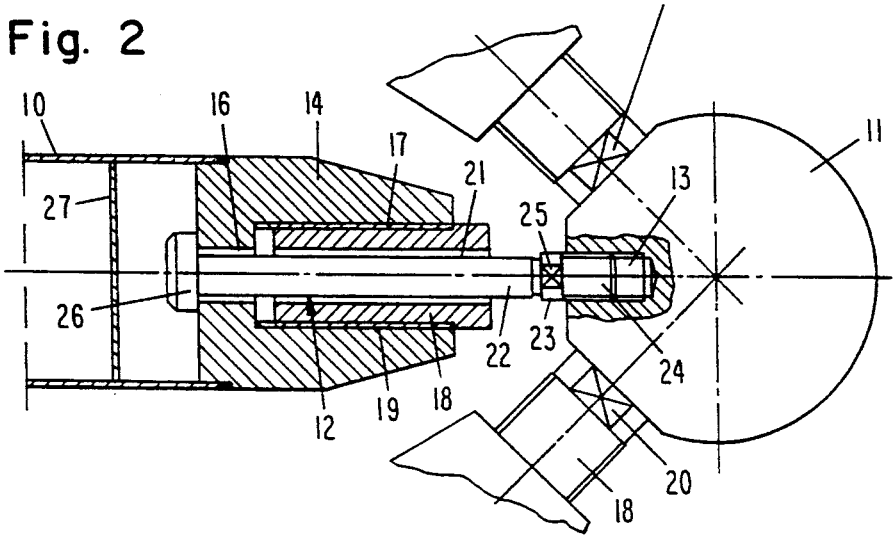
FIG. 2 is an elevation of the joint connection-system similar to that of FIG. 1, wherein however the tap bolt of the third member connector already was rotated into a threaded borehole of the joint-adapter.
Figure 3:
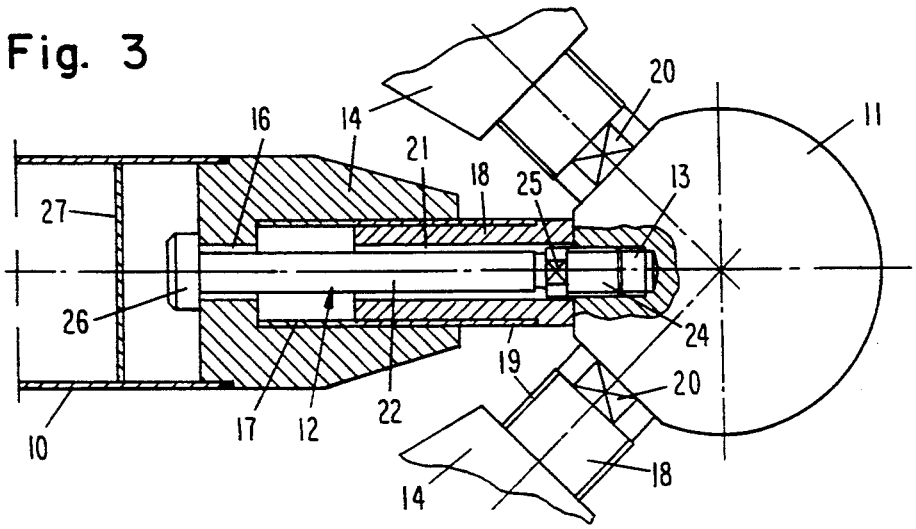
FIG. 3 is a further view of the joint connection-system of FIGS. 1 and 2 with a complete third member connector, wherein the prestressing muff of the third member connector also rests against the joint-adapter.

The joint connection-system shown in FIGS. 1 through 3 is part of a three-dimensional truss consisting of pipe-members 10 and joint-adapters 11. Only one end of the members 10 is shown in FIGS. 1 through 3. Both ends of the members 10 however are identical. Illustratively and for the sake of clarity, only three pipe members 10 are affixed to the joint-adapter 11. A tap bolt 12 connects each end of the pipe members 10 to a joint-adapter 11 and is screwed into one of several concentric threaded boreholes 13 in the joint-adapter 11.

A relatively elongated and essentially frusto-conical member-endpiece 14 is affixed by an annular welding seam 15 to each end of the pipe members 10. The member-endpieces 14 each comprise a smooth-cylindrical and axial borehole 16 outwardly and coaxially adjoined by a threaded borehole 17 of which the diameter is larger than that of the borehole 16. A prestressing muff 18 with a suitable outer thread 19 is screwed into the threaded borehole 17; the length of said thread 19 is only slightly larger than that of the threaded borehole 17. When the prestressing muff 18 is completely or nearly completely rotated into the member-endpiece 14 (FIGS. 1, 2), a terminal segment of this prestressing muff 18 will still project from the member-endpiece 14. This terminal segment comprises several flats 20 on its outer periphery which may seat a suitable wrench or the like to rotate the prestressing muff 18. The prestressing muff 18 furthermore comprises an axial borehole 21 of which the diameter illustratively corresponds to that of the borehole 16 in the member-endpieces 14.

Each tap bolt 12 in the member-endpieces 14 of the pipe members 10 comprises a smooth-cylindrical shank 22, further a non-circular segment 23 and a threaded segment 24. The non-circular segment illustratively consists of several flats 25 serving as rotating accessories, that is, to seat a wrench or the like in order to rotate the tap bolt 12 into a threaded borehole 13 of the joint-adapter 11 in the manner shown in FIG. 2. Alternatively, the tap bolt 12 has radial boreholes 34, see FIG. 4, in the shank for tap bolt rotation using a rotating tool. Be it also borne in mind that the cylindrical shank 22 of the tap bolt 12 passes through the boreholes 16 and 21 with some lateral play so that relative rotation between these parts may take place. FIG. 2 shows that when a tap bolt 12 is screwed in place in a threaded borehole 13 of the joint-adapter 11, the head 26 of said bolt rests against the end face of the member-endpiece 14 located in the pipe member 10, whereby said endpiece simultaneously serves as a rest for the tap bolt 12.

The prestressing muff 18 is rotated out the member-endpiece 14 in order to axially prestress the tap bolt 12 by using a rotating tool, for instance a wrench placed against the flats 20 of the prestressing muff 18. As soon as the prestressing muff comes to rest against the joint-adapter 11, further rotation in the same direction of the prestressing muff 18 will implement the axial prestressing, i.e. stretching of the tap bolt 12.

If the member connection to the joint-adapter 11 must be released, the reverse sequence is followed, that is, first the prestressing muff 18 is rotated into the member-endpiece 14 and thereupon, using a rotational tool on the non-circular segment 23, the tap bolt 12 can be rotated by its threaded segment 24 out of the threaded borehole 13 into the initial position shown in FIG. 1.

To prevent the tap bolt 12 (FIG. 1) when in the assembly-ready position from slipping into the cavity of the pipe member 10, this embodiment shows a securing element 27, for instance in the form of a disk or strip which is provided at a given axial distance from the member-endpiece 14 and is affixed to the inside wall of the pipe member 10. A clip or shackle also may be affixed for instance to the member-endpiece 14 to overlap the head 26 of the bolt 12; this securing element is indicated in dashed lines in FIG. 1.

Figure 4:
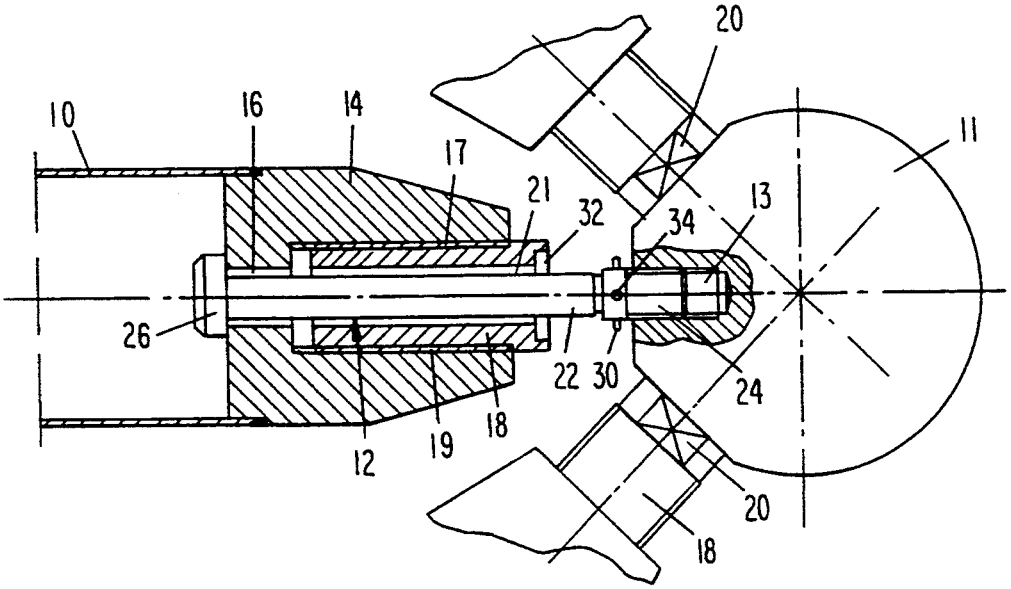
FIG. 4 is an elevational of the joint connection system similar to FIG. 2 showing another embodiment of the invention.

Lastly, referring to FIG. 4, the above described securing elements also may be replaced for instance by a securing pin 30 at the cylindrical shank 22 of the tap bolt 12; the end face of the prestressing muff 18 shown in FIGS. 1 through 3 serve as a stop for said securing pin. In this case an omitted annular recess 32 is provided at this end face to receive in sunk manner this securing pin so that when the tap bolt 12 is being prestressed, the particular end face of the prestressing muff 18 can snugly rest against the joint-adapter 11.

I claim:

1. In a joint connection-system for trusses, using members and joint-adapters, the joint adapters having threaded boreholes therein to receive tap bolts each tap bolt passing through a borehole in a member-endpiece the member-endpiece being joined to said member, each borehole forming a stop for a bolt head of the tap bolt, the tap bolt being rotatable into a threaded borehole of the joint-adapter and being axially clampable by a prestressing muff surrounding a shank of the bolt, the improvement comprising:

a) the member-endpiece further comprising a threaded borehole located outward of, coaxial with and adjoining to the borehole in the member endpiece, the prestressing muff sized and fitted with a matching outer thread to rotatably engage said threaded borehole, b) the prestressing muff further comprising an axial borehole sized to allow the tap bolt to pass therethrough, and c) means for rotating said tap bolt comprising one of a flat-containing non-circular segment of the shank portion of said tap bolt or radial boreholes in the shank of the tap bolt.

2. The joint connection-system defined in claim 1, wherein a length of the threaded borehole in the member-endpiece is equal to or less than a length of the prestressing muff.

3. The joint connection-system defined in claim 1, further comprising a securing element for preventing the tap bolt from moving out of the member-endpiece, said securing element mounted in a hollow portion of said member and adjacent said endpiece.

4. The joint connection-system defined in claim 1, further comprising a securing pin for preventing the tap bolt from moving out of the member-endpiece, the securing pin affixed inward to the shank of the tap bolt and cooperating with an annular recess in an outer end of the prestressing muff.

5. The joint connection-system defined in claim 1, wherein said means for rotating comprises said flat-containing non-circular segment of the shank portion of the tap bolt.

* * * * *